US006222134B1

(12) United States Patent
Aoyama et al.

(10) Patent No.: US 6,222,134 B1
(45) Date of Patent: Apr. 24, 2001

(54) LP INSULATOR ASSEMBLY AND METHOD FOR ASSEMBLING THE SAME

(75) Inventors: Kunitoshi Aoyama, Komaki; So Kawamura, Kasugai, both of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/184,860

(22) Filed: Nov. 3, 1998

(30) Foreign Application Priority Data

Nov. 6, 1997 (JP) ..... 9-304614

(51) Int. Cl.[7] ..... H01B 17/14

(52) U.S. Cl. ..... 174/158 R; 174/45 TD; 174/173; 174/158 F

(58) Field of Search ..... 174/139, 148, 174/158 R, 168, 163 R, 173, 150, 152 R, 158 F, 162, 209, 211, 212, 45 R, 45 TD, 41, 43, 40 R, 44; 206/386

(56) References Cited

U.S. PATENT DOCUMENTS 2,443,202 * 6/1948 Smith ..... 259/54
2,446,914 * 8/1948 Fallert et al. ..... 248/120
2,584,762 * 2/1952 Vossenberg ..... 248/120
3,267,202 * 8/1966 Leonard ..... 174/45
3,445,582 * 5/1969 Herrenkohl et al. ..... 174/43
4,679,672 * 7/1987 Seddon et al. ..... 191/141
4,852,330 * 8/1989 Carangelo ..... 53/399
5,750,936 * 5/1998 Wheatley et al. ..... 174/138 G

* cited by examiner

*Primary Examiner*—Kristine Kincaid
*Assistant Examiner*—W. David Walkenhorst
(74) *Attorney, Agent, or Firm*—Parkhurst & Wendel, L.L.P.

(57) ABSTRACT

There are disclosed a method for assembling LP insulators in which no box housing is used, assembling operation is facilitated and various product lengths can be handled, and an LP insulator assembly which is lightweight because of a small amount of packing materials for use, which produces only a small amount of waste materials after unpacking and whose insulators are easily lifted. An LP insulator assembly 1 includes an LP insulator 2 mainly constituted of a shaft body 3, an engaging member 4 and a support fitting 5; a pallet 9 in which flat plates are arranged on spacer members 7 to form a deck surface and on which the LP insulator 2 is vertically placed; a fixing member 10 for fixing the support fitting 5 to the pallet; and a tying member 12 for tying the engaging members 4 to one another. The deck surface of the pallet and the support fitting 5 are fixed by the fixing member 10, a plurality of LP insulators 2 are vertically placed, and the engaging members 4 of the LP insulators 2 are tied to one another.

11 Claims, 8 Drawing Sheets

LP INSULATOR ASSEMBLY AND METHOD FOR ASSEMBLING THE SAME

BACKGROUND OF THE INVENTION (i) Field of the Invention

The present invention relates to an LP insulator assembly attached to an electric post or another post for connecting electric wires, and a method for assembling the same.

(ii) Description of the Related Art

An LP insulator (line post insulator) is an outdoor insulator for frequent use especially in U.S. The insulator for supporting an electric wire is, as shown in FIG. 2, mainly constituted of a shaft body 23 of an organic insulating material provided with a clamp or engaging member 24 on a tip end and a base or support fitting 25 on the other end. The shaft bodies 23 are supported by fixing the bases 25 onto a multiplicity of posts 21 such as electric posts, pyla, and the like. By engaging electric wires with the clamps 24 on the tip ends of the shaft bodies 23, the electric wires are arranged/connected for use.

For the purpose described above, a multiplicity of LP insulators are used at the same time. Therefore, in the conventional art shown in FIG. 3, two spacers or support members 29 are pre-arranged perpendicularly to the longitudinal direction of the LP insulators to be contained in a box housing 28 of plywood. A plurality of LP insulators are alternately arranged in such a manner that the bases 25 and the clamps 24 are alternately arranged on the top face of the support members 29. As the case may be, the arrangement is repeated in a plurality of stages, stacked, and assembled in the box housing 28 for transport.

However, in the assembling method using the box housing, there are problems that the installation of the spacers into the box housing is laborious, it is difficult to assemble heavy insulators in a deep box housing, box housings adapted for various product lengths or sizes are necessary, the total weight including the box housing is heavy, a large storage space is necessary for unused box housings and that unnecessary box housings after transport generate an enormous amount of waste materials even if disassembled. These problems remarkably add to the transport cost of LP insulators.

Moreover, since the occupancy volume of the support fitting of the LP insulator is very large relative to that of the shaft body, the box housing cannot be densely filled with the insulators. Additionally, since the weight of the support fitting is also heavy, the box housing needs to be rigid sufficiently to bear the load concentrated onto the outer periphery of the housing. Therefore, the conventional assembling method is not necessarily efficient.

Furthermore, in order to mount the insulator onto the post or the like, the engagement member on the tip end is lifted with a crane or the like. In this case, the insulator needs to be once raised to direct the shaft body upward before lifted. Therefore, it cannot be said that the assembling method is developed by sufficiently considering the structural and operational characteristics of the LP insulator.

SUMMARY OF THE INVENTION

The present invention has been developed in consideration of the problems of the conventional art described above, and an object thereof is to provide a method for assembling LP insulators in which no box housing is used, assembling operation is facilitated, and various product lengths can be handled, and to provide an LP insulator assembly which is lightweight because of a small amount of packing materials, produces only a small amount of waste materials after unpacking and whose insulators are easily lifted.

The present inventors et al. have studied the above-mentioned problems, noted that the shaft body of LP insulator is rigid against bending stress and has a cantilever type support fitting, and have developed the present invention.

Specifically, the present invention provides an LP insulator assembly which comprises an LP insulator mainly constituted of a shaft body formed of an organic insulating material for carrying a mechanical load, an engaging member attached to a tip end of the shaft body for supporting an electric wire and a support fitting for mounting the shaft body onto a post; a pallet in which at least one flat plate is arranged on at least two spacer members arranged in parallel and perpendicularly to the spacer members to form a deck surface and on which the LP insulator is vertically placed; a fixing member for fixing the support fitting to the pallet; and a tying member for tying the engaging members. The support fittings are fixed to the pallet deck surface by the fixing members, a plurality of LP insulators are vertically placed, and the engaging members of LP insulators are tied to one another.

In the assembly of the present invention, two groups of LP insulators are preferably arranged in parallel on the deck surface of the pallet, and more preferably arranged in parallel in the same direction as the longitudinal direction of the spacer member of the pallet.

Moreover, in the LP insulator assembly in which attachment holes are made for mounting LP insulators onto the post, the support fittings are preferably fixed to the pallet deck surface by engaging the fixing members in the attachment holes. A wood screw is used as the fixing member. By screwing the wood screw on the pallet deck surface, the support fittings are preferably fixed to the pallet deck surface.

When the wood screw is used as the fixing member, the pallet deck surface is preferably formed by arranging two or more flat plates with no gap made thereamong on the spacer members. A cushion member is preferably inserted between the head of the wood screw and the support fitting, and the inserted cushion member is more preferably divided for each wood screw.

Moreover, when the LP insulator assembly includes the LP insulator whose shaft body is inclined relative to the support fitting and the pallet which is provided with a step in the center part of the deck surface, the LP insulator is preferably placed more vertically by fixing to the step one end of the support fitting on the side to which the shaft body is inclined and fixing the other end to the deck surface.

Furthermore, in the assembly of the present invention, at least a lower half of the vertically placed LP insulator is preferably covered with a protecting member.

According to the present invention, there is also provided a method for assembling a plurality of LP insulators. Each of the LP insulators is mainly constituted of a shaft body of an organic insulating material for carrying a mechanical load, an engaging member attached to a tip end of the shaft body for supporting an electric wire and a support fitting for mounting the shaft body onto a post. At least one flat plate is arranged on at least two spacer members arranged in parallel and perpendicularly to the spacer members to form a deck surface. A plurality of LP insulators are arranged on the deck surface of the pallet, the support fittings are fixed to the pallet, and the engaging members of LP insulators are tied to one another.

DETAILED DESCRIPTION OF THE PREFERRED EMBODIMENTS

Since the present invention relates to an assembling method and an assembly of LP insulators, an insulator will first be described roughly.

Figure 2:
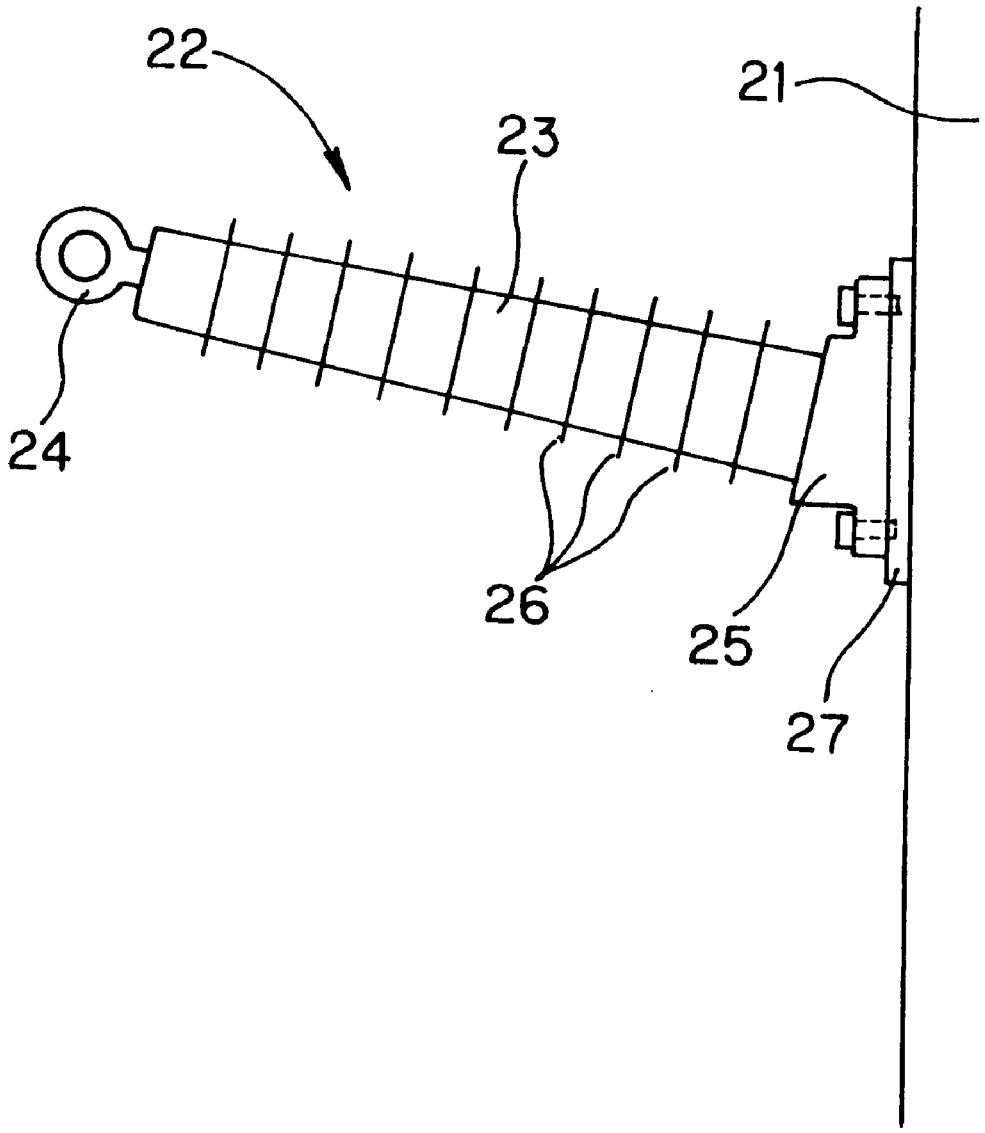
FIG. 2 is a schematic diagram showing a structure of LP insulator.
Figure 3:
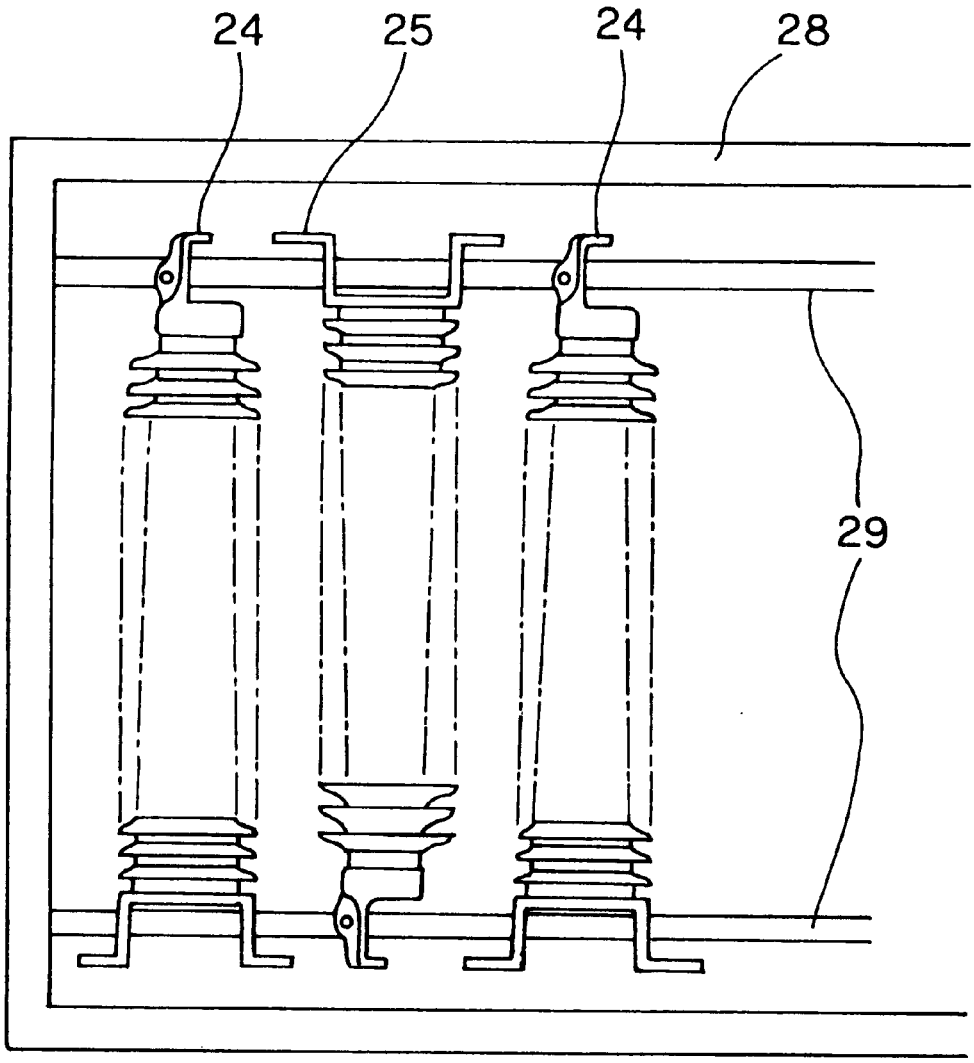
FIG. 3 is a top view showing a conventional method of assembling LP insulators.

As aforementioned, LP insulator (line post insulator) is an outdoor insulator for connecting electric wires as aforementioned. For example, as shown in FIG. 2, the insulator is mainly constituted of the shaft body 23 of an organic insulating material provided with the engaging member 24 on the tip end and the support fitting 25 on the support end. By covering the periphery with disc-shaped shades 26, the shaft body 23 is protected.

In operation, the support fitting 25 on the support end of the shaft body 23 is directly fixed to the post 21 such as an electric post, a pylon, and the like, or indirectly fixed to a seat 27 attached to the electric post or the like, while the electric wire is engaged with the engaging member 24 on the tip end of the shaft body 23.

Since the shaft body 23 needs to support the electric wire having a substantial weight in a cantilever manner, it is formed of FRP core or another material which can bear a mechanical strength (mainly a bending strength). Moreover, the shell diameter of the shaft body is three or four times as large as that of a suspension insulator or the like.

In the present invention, the assembly is constituted by the assembling method in which a plurality of above-mentioned LP insulators are vertically placed on a pallet deck surface.

According to the assembling method, the box housing is unnecessary, the assembling operation is easily performed, and various product lengths can be handled.

Furthermore, the assembly constituted using the assembling method is lightweight because of a small amount of packing materials for use, the amount of waste materials after unpacking is also small, and the insulators are easily lifted.

The assembly and the assembling method of the present invention will hereinafter be described in detail.

The pallet for use in the assembly of the present invention is usually a deck formed of a wood or another material for storage/transport of a cargo. For example, as shown in FIG. 4, at least one flat plate is arranged on at least two spacer members 31 arranged in parallel and perpendicularly to the spacer members 31 to form a square or rectangular deck surface 33.

A large one plate may be used for forming the deck surface 33, but a plurality of short strip shaped flat plates 32 are usually arranged perpendicularly to the spacer members 31.

The spacer member is not especially limited as long as its material and shape can bear a stacked load, but a thick wooden flat plate is usually for preferable use.

The deck surface 33 is formed on both or either of front and back surfaces. Usually, when the deck surface 33 is formed on only one surface, at least opposite edges of each spacer member on the other surface are provided with flat-plate reinforcing members to assure the strength of the pallet. Specifically, in either case, the front and back surfaces of the spacer members are held by the flat-plate members.

In operation, for example, a cargo is laid and fixed on the deck surface 33. While forklift prongs are inserted in holes 34 defined by the flat plates holding the spacer members 31 on the front and back surfaces, the pallet can be lifted and moved. Furthermore, by stacking the pallet on a trailer deck or the like, the pallet can be transported a long distance.

There are various sizes and shapes of pallets in accordance with purposes, i.e., the sizes and shapes of cargoes, but a pallet with 42 inch sides is preferably used in the present invention.

The pallet has standard specifications in U.S., which is a major market of LP insulators, and has high general-purpose properties because it can be shared for another purpose.

Figure 4A:
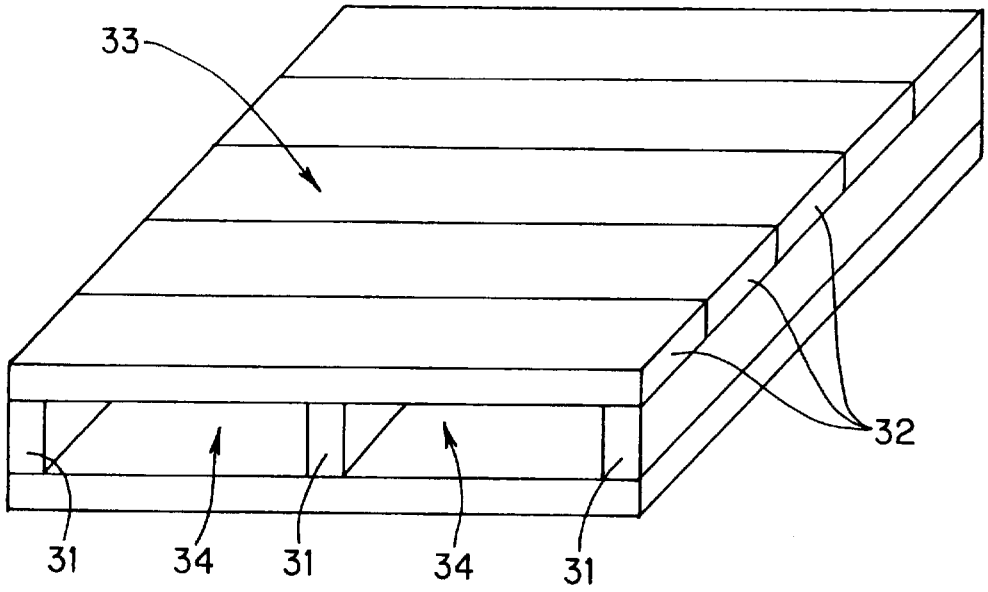
FIGS. 4A and 4B are perspective views diagrammatically showing a whole surface type pallet and a drainboard type pallet for use in the assembly of the present invention, respectively.
Figure 4B:
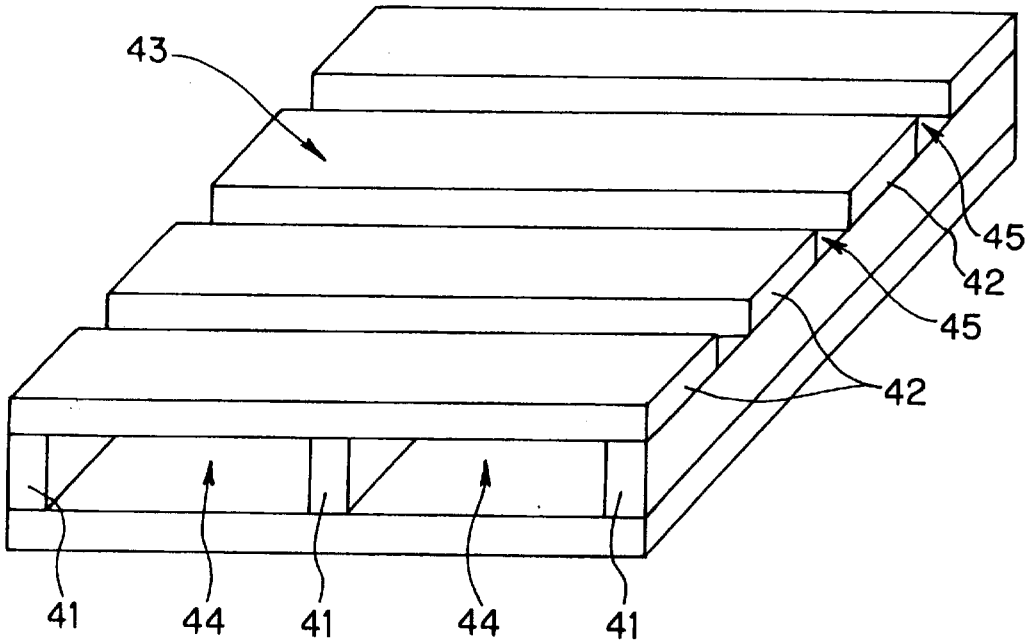

As the structures of the pallet deck surface, there are provided a whole surface type shown in FIG. 4A in which no gap is made among the flat plates 32 forming the deck surface 33, i.e., the flat plates 32 are continuously arranged, and a drainboard type shown in FIG. 4B in which flat plates 42 are intermittently arranged to form a deck surface 43. The whole surface type is preferably used.

In the drainboard type, there is a fixing member with which the support fitting cannot be fixed to a gap 45 between the flat plates 42, but in the whole surface type, a region in which the fixing position of the support fitting onto the deck surface 33 can be selected is broad irrespective of the type of the fixing member.

Therefore, various shapes or sizes of the support fittings can be used, and the insulators can stably be fixed to the pallet.

Furthermore, a step may be provided on the pallet deck surface, for example, by nailing a stair tread to the center part of the deck surface or otherwise.

As shown in FIG. 2, the shaft body may be inclined relative to the support fitting in order that the electric wire be supported from downward by the LP insulator.

Even in the LP insulator, by forming the step on the center part of the pallet as aforementioned, the shaft body can be placed almost vertically.

Steps may be formed on opposite edges of the pallet. In this case, however, since the shaft body is inclined about 12 degrees relative to the support fitting, the steps need to be formed high in order to position the tip end of the shaft body on the pallet.

Therefore, the step is formed in such a manner that the center part of the deck surface is raised, one end of the support fitting is laid on the step while the other end is laid on the part other than the step, i.e., the edge of the pallet, and the support fitting is inclined to fix the LP insulator.

In the fixing method, even when two groups of insulators are arranged in parallel, the tip ends of the insulators arranged opposite to each other are prevented from contacting each other.

The fixing member is provided for fixing the LP insulator to the pallet deck surface. In the present invention, the support fitting of the LP insulator is fixed by the fixing member.

Since the LP insulator is usually attached to the post or the like using bolts or the like, the support fitting is provided with attachment holes into which the bolts or the like are loosely inserted.

By loosely inserting wood screws or other fixing members into the attachment holes to engage the support fitting and the fixing members, the LP insulator can securely be fixed to the pallet.

The shape, material and fixing method of the fixing member are not especially limited as long as the insulator can be fixed and, for example, bolts, wires, and the like may be used. Since the pallet is usually of wood, wood screws are preferably used.

For the wood screw, a screw portion is conical, and threaded at coarse pitches into triangular sections. For example, by turning a hexagonal screw head with a wrench or the like, the screw is inserted and fixed/tightened into wood or metal. By using the wood screw, the insulator can be fixed easily and firmly.

Moreover, when the wood screw is used as the fixing member, a cushion member is preferably inserted between the screw head and the support fitting.

In this manner, the insulator can be fixed without damaging the support fitting. Even if the attachment hole of the support fitting is larger than the head of the bolt, the cushion member can serve as a washer.

The shape, material, and the like of the cushion member are not especially limited as long as it fails to damage the insulator support fitting and it has a strength such that it does not break at the time of fixing. For example, a wood piece, a plastic piece, a metallic piece, or the like is preferably used.

Figure 5A:
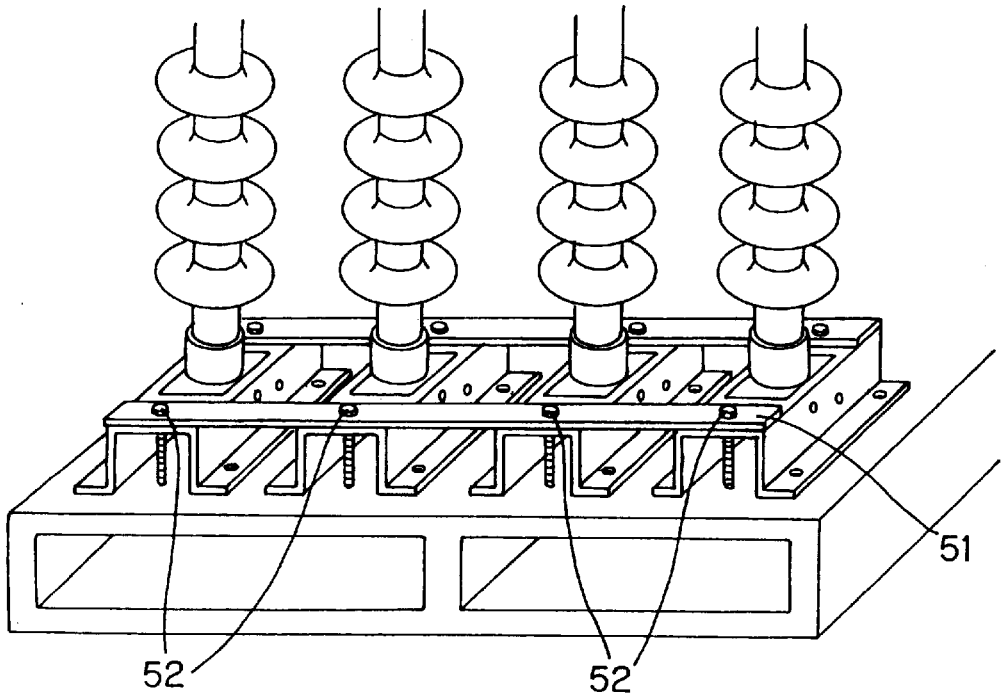
FIGS. 5A and 5B are perspective views diagrammatically showing cushion members for use in the assembly of the present invention.
Figure 5B:
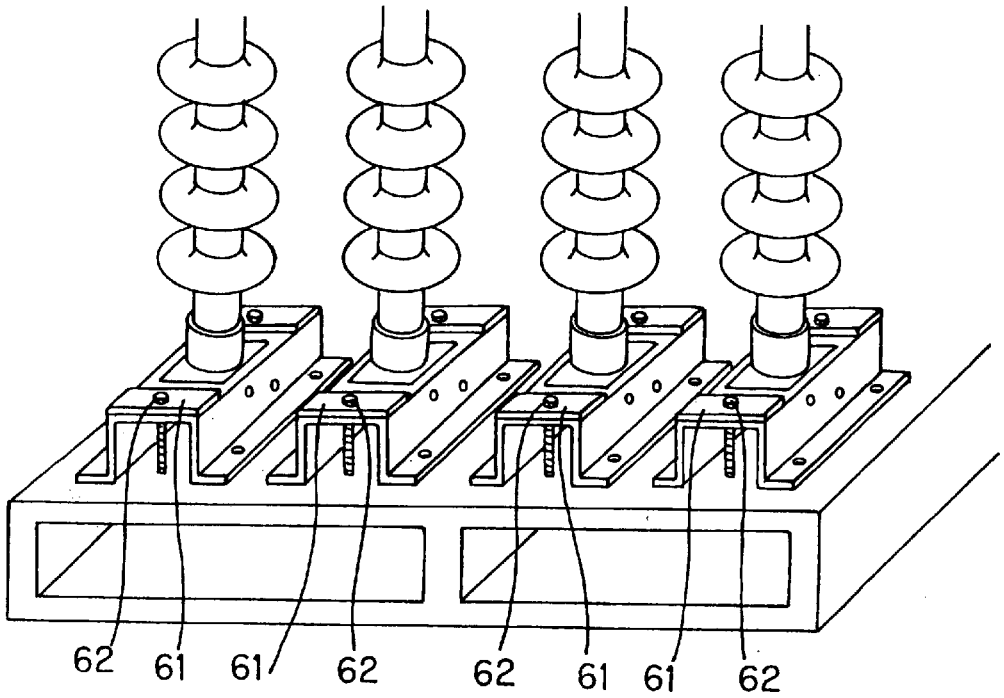

For the cushion member, as shown in FIG. 5A, one cushion member 51 may be used for a plurality of wood screws 52, but it is preferable that, as shown in FIG. 5B, the cushion member be divided for each wood screw 62.

In the fixing method, even when transported to an installation site, the individual insulators can be separated, lifted and mounted onto a post or the like. During this operation, the other insulators can be kept in fixed conditions.

In the present invention, the tying member is provided for tying the engaging members on the tip ends of the vertically placed LP insulators, and its shape or material is not especially limited as long as the insulators can be tied.

For example, ropes, bands, plates, and the like can be used. As the material, plastic, fiber, wood, or the like can be used. When wood is used, nailing operation needs to be performed on the upper portion of the insulator. Therefore, ropes or bands formed of plastic or fiber are preferably used.

Figure 6A:
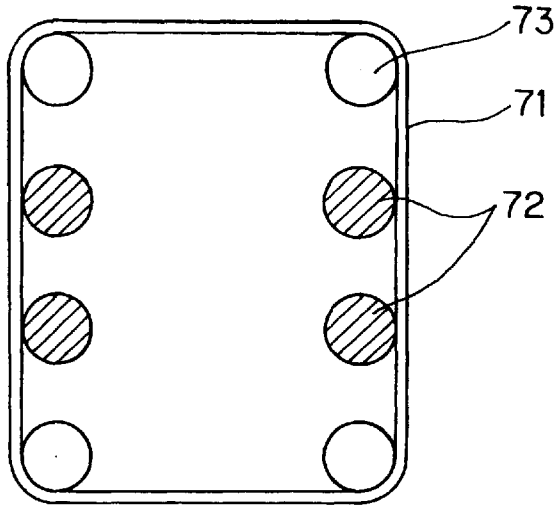
FIGS. 6A, 6B and 6C are top views diagrammatically showing methods of tying insulators in the assembly of the present invention.

Specifically, in a case two rows each of four insulators, i.e., eight insulators in total are fixed on the pallet, two rows each of two insulators 72 positioned in the center part cannot be sufficiently tied just by tying a single rope 71 only around the outer periphery as shown in FIG. 6A.

Figure 6B:
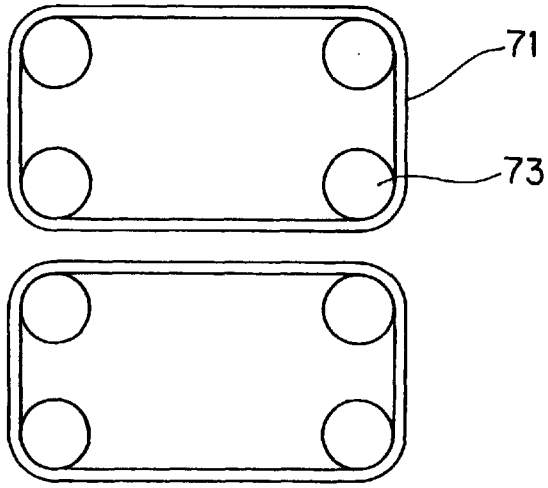
Figure 6C:
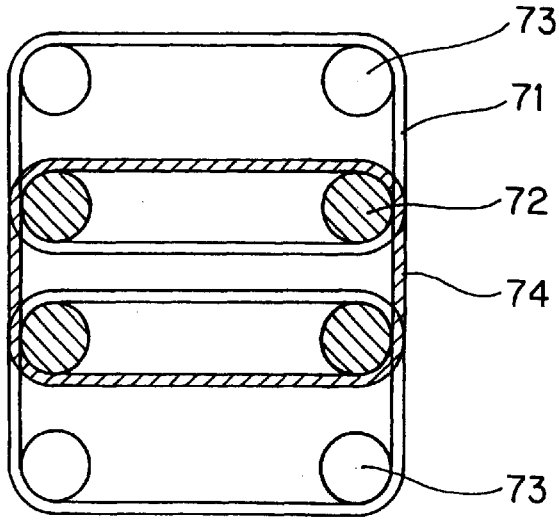

Therefore, the insulators are preferably divided into two sets each of two rows each of two insulators and tied as shown in FIG. 6B. As shown in FIG. 6C, especially preferably, two rows each of two insulators 72 positioned in the center part are also tied with a rope 74, so that eight insulators 73, 74 are tied with one another.

The tying method is preferable in that the cargo of insulators is prevented from collapsing.

In the assembly of the present invention, at least a lower half of the vertically placed LP insulator is preferably covered with a protecting member. About 0.8 to 1.0 m is preferably covered, which varies in accordance with the length of the insulator.

By covering only the lower portion relatively susceptible to impact during transport, the lower portion of the insulator can be protected from the impact, and the amount of packing materials for use can be reduced.

As the protecting member, for example, a plywood, a waterproof corrugated board, a plastic plate, or another material which can resist outdoor storage can be used. Specifically, a corrugated plastic plate is preferably used.

After the protecting member is wound around the outer periphery of the insulator, it is fastened with a tape, a rope, or the like.

Figure 7B:
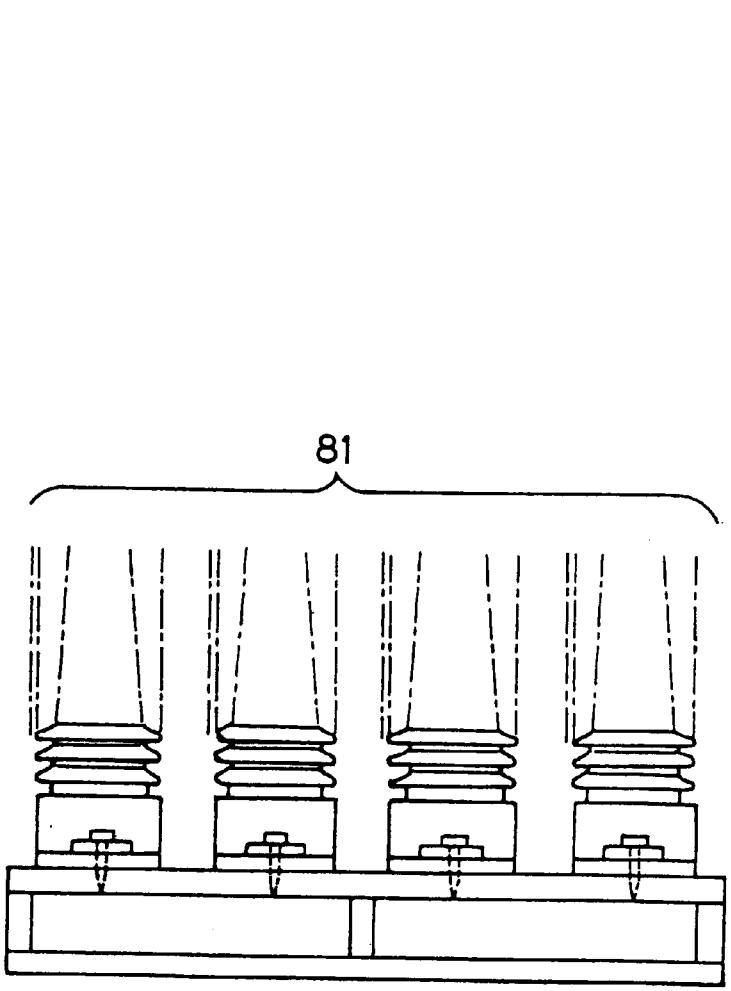
FIG. 7B is a side view thereof.
Figure 7A:
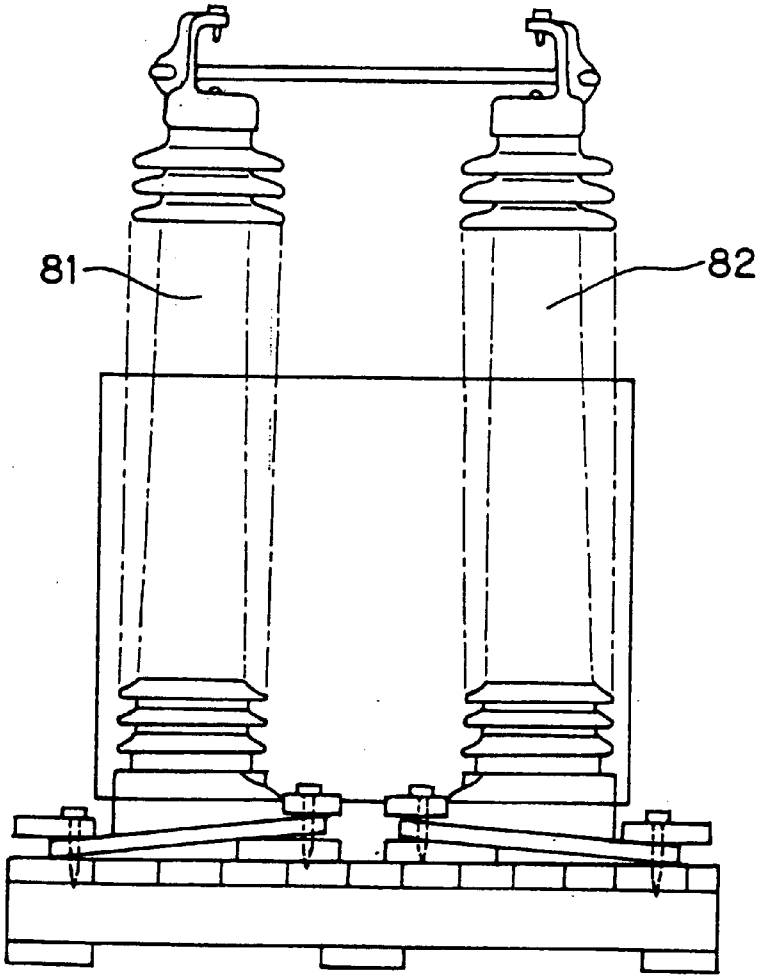
FIG. 7A is a front view of an example of an assembly in which two groups of LP insulators are arranged in parallel on a pallet deck surface.

In the assembly of the present invention, as shown in FIG. 7, two groups 81, 82 of LP insulators are arranged in parallel on the pallet deck surface, which can enhance assembly efficiency.

Figure 1A:
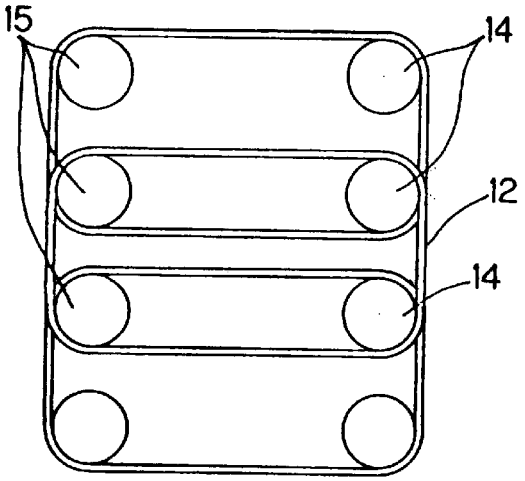
FIG. 1A is a top view of an assembly according to an embodiment of the present invention.
Figure 1C:
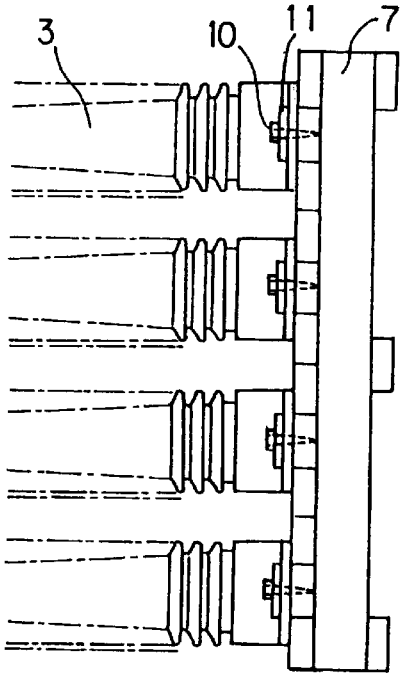
FIG. 1C is a side view thereof.
Figure 1B:
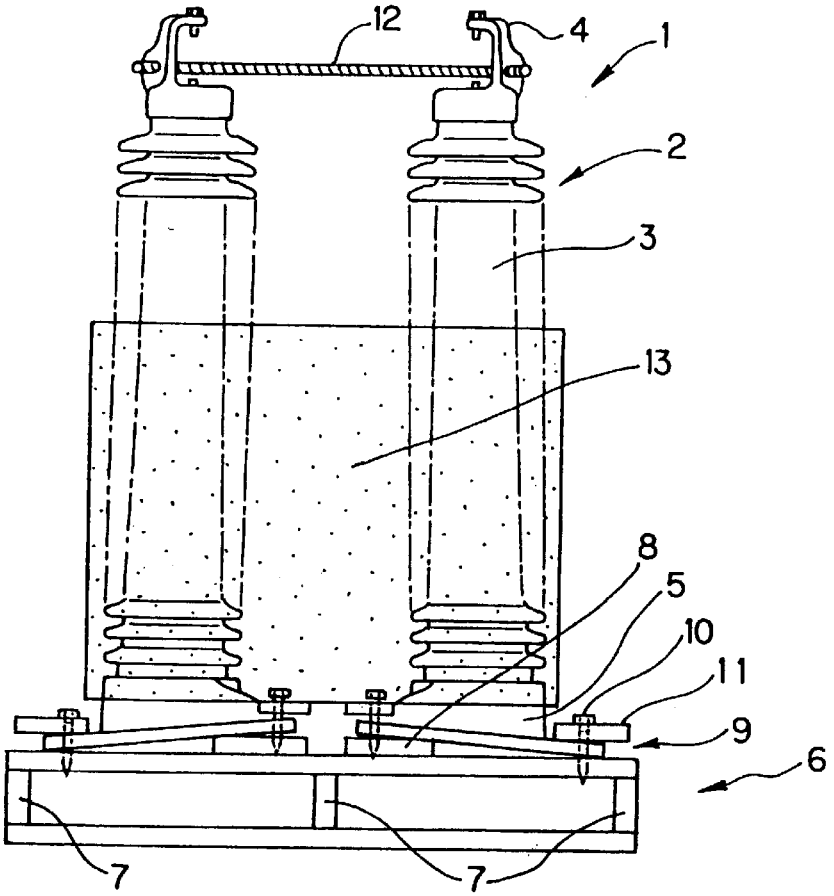
FIG. 1B is a front view thereof.

Moreover, as shown in FIG. 1, two groups 14, 15 of LP insulators are preferably arranged in parallel along the same direction as the longitudinal direction of a spacer member 7 of a pallet 6.

The assembly is usually stacked from the transverse side of a trailer deck. When the insulator groups are arranged in the aforementioned direction, the trailer deck and the assembly are tied/fixed simply by passing ropes or the like between two rows or groups of insulators. Therefore, different from the assembly of FIG. 7, the assembly can easily be tied/fixed without damaging the insulators.

The embodiment of the LP insulator assembly according to the present invention will be described below, but the present invention is not limited to the illustrated embodiment.

FIRST EXAMPLE

An LP insulator assembly was constituted in the same manner as in FIG. 1.

Figure 8:
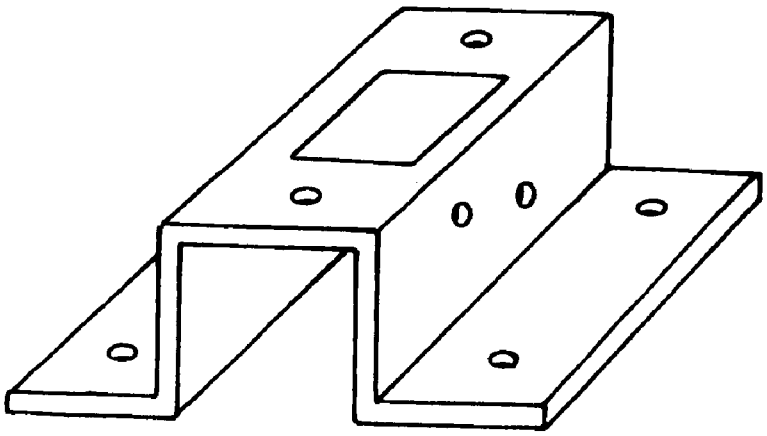
FIG. 8 is a perspective view diagrammatically showing a support fitting of LP insulator for use in the embodiment of the present invention.

In the example, LP insulators each having a total length of 1600 mm, a shell diameter of 74 mm and a shade diameter of 149 mm were used, and support fittings each having a bendable flat shape as shown in FIG. 8 were used.

Additionally, a whole surface type wood pallet with 42 inch sides was used as the pallet 6 in which the spacer members 7 with a height of 90 mm were held on opposite edges and a center part under the deck surface, and 20 mm thick stair treads 8 were nailed on the center part of the deck surface to form steps.

First, the opposite ends of the support fitting 5 of the LP insulator 2 were inclined and laid on the stair tread 8 in the center of the deck surface of the pallet 6 and an edge 9 of the deck surface. The stair tread 8 was screwed on the deck surface with a wood screw 10 using an attachment hole formed in the support fitting 5.

At this time, the stair tread was fixed via a cushion member or wood piece 11 with a thickness of 20 mm and 90 mm sides to prevent the head of the wood screw 10 from abutting on the support fitting 5.

In the same manner, eight LP insulators 2 were vertically arranged in two rows each of four insulators. They were arranged in the same direction as the longitudinal direction of the spacer member 7 of the pallet 6.

After the eight LP insulators 2 were vertically fixed, the engaging members 4 on the tip ends of the LP insulators 2 were tied with a plastic rope 12.

At this time, two adjacent rows each of two insulators were tied as one unit. In order not to separate the units, two insulators each of the units positioned in the center part were again tied as one unit. Specifically, the eight LP insulators were divided in the units of two rows each of two insulators, and tied three times.

Finally, a corrugated plastic plate 13 having a thickness of 3 mm and a width of 800 mm was wound around the lower portions of the LP insulators 2 as the protecting member of LP insulators 2, and fastened with an adhesive tape.

As aforementioned, according to the assembling method of the present invention, no box housing needs to be used, assembling operation is facilitated, and various product lengths can be handled.

Moreover, the assembly constituted using the assembling method has a built-up construction. Therefore, it can be disassembled into only pallets for storage when unused. Different from an empty box housing, no storage space is necessary. The packing materials for use are smaller in amount and lighter in weight as compared with the box housing. Additionally, the amount of waste materials after unpacking is reduced, and the insulators are easily lifted.

Furthermore, since the support fitting heaviest among the insulator components is positioned in the lower end, the insulator can stably be placed.

What is claimed is:

1. An LP insulator assembly and a packing assembly which comprises:

a plurality of LP insulators, each including a shaft body formed of an organic insulating material for carrying a mechanical load, an engaging member attached to a tip end of the shaft body for supporting an electric wire and a support fitting for mounting the shaft body onto a post;

a pallet in which at least one flat plate having a step is arranged on at least two spacer members arranged in parallel and perpendicularly to the spacer members to form a deck surface on which the support fitting has one end placed on the step so said LP insulator is vertically placed;

a fixing member for fixing said support fitting to the pallet; and a tying member for typing said engaging members, the deck surface of the pallet and the support fitting being fixed by the fixing member, said plurality of LP insulators being vertically placed, and the engaging members of the LP insulators being tied to on another.

2. The LP insulator assembly according to claim 1 wherein two groups of said LP insulators are arranged in parallel on the deck surface of the pallet.

3. The LP insulator assembly according to claim 2 wherein the two groups of LP insulators are arranged in parallel in the longitudinal direction of the spacer member of the pallet.

4. The LP insulator assembly according to claim 1 wherein an attachment hole is made in the support fitting for mounting one of the LP insulators onto the post, and the pallet deck surface and the support fitting are fixed by the fixing member engaged in the attachment hole.

5. The LP insulator assembly according to claim 1 wherein a wood screw is used as the fixing member, and the pallet deck surface and the support fitting are fixed by screwing the wood screw on the pallet deck surface.

6. The LP insulator assembly according to claim 5 wherein the pallet deck surface is formed by arranging two or more flat plates with no gap made thereamong on the spacer members.

7. The LP insulator assembly according to claim 5 wherein a cushion member is inserted between a head of the wood screw and the support fitting.

8. The LP insulator assembly according to claim 7 wherein there is a separate cushion member for each wood screw.

9. The LP insulator assembly according to claim 1 which comprises the LP insulator whose shaft body is inclined relative to the support fitting and the pallet which is provided with a step in a center part of the deck surface, the LP insulator being vertically placed by fixing to said step one end of the support fitting on the side to which the shaft body is inclined and fixing the other end to the deck surface.

10. The LP insulator assembly according to claim 1 wherein at least a lower half of the vertically placed LP insulator is covered with a protecting member.

11. A method for assembling and packing a plurality of LP insulators each of which is constituted of a shaft body formed of an organic insulating material for carrying a mechanical load, an engaging member attached to a tip end of the shaft body for supporting an electric wire, and a support fitting for mounting the shaft body onto a post, said method comprising the steps of:

vertically placing the plurality of LP insulators on a deck surface which is formed on a pallet by arranging at least one flat plate having a step on at least two spacer members arranged in parallel and perpendicularly to the spacer members by mounting one end of the support fitting on the step; fixing the support fittings to the pallet; and tying the engaging members of the LP insulators to one another.

* * * * *